US008287057B2

(12) United States Patent
Sevillano Gil

(10) Patent No.: US 8,287,057 B2
(45) Date of Patent: Oct. 16, 2012

(54) LOCKING SYSTEM FOR FURNITURE DRAWERS

(75) Inventor: Benito Sevillano Gil, Elgoibar (ES)

(73) Assignee: Ojmar, S.A., Elgoibar (Gipuzkoa) (ES)

( * ) Notice: Subject to any disclaimer, the term of this patent is extended or adjusted under 35 U.S.C. 154(b) by 135 days.

(21) Appl. No.: 12/528,240

(22) PCT Filed: Sep. 20, 2007

(86) PCT No.: PCT/ES2007/000533

§ 371 (c)(1),
(2), (4) Date: Aug. 21, 2009

(87) PCT Pub. No.: WO2008/102024

PCT Pub. Date: Aug. 28, 2008

(65) Prior Publication Data

US 2011/0005283 A1 Jan. 13, 2011

(30) Foreign Application Priority Data

Feb. 23, 2007 (ES) ..... 200700483

(51) Int. Cl.
*E05C 7/06* (2006.01)

(52) U.S. Cl. ..... 312/221

(58) Field of Classification Search ..... 312/215, 312/217, 221, 222, 216, 218, 330.1, 333, 312/107.5

See application file for complete search history.

(56) References Cited

U.S. PATENT DOCUMENTS

| | | | | | |
|---|---|---|---|---|---|
| 2,199,881 | A | * | 5/1940 | Hedlund | 62/300 |
| 4,272,138 | A | * | 6/1981 | Stark | 312/221 |
| 4,429,930 | A | * | 2/1984 | Blouin | 312/216 |
| 4,447,098 | A | * | 5/1984 | Parker | 312/216 |
| 4,480,883 | A | * | 11/1984 | Young | 312/220 |
| 4,768,844 | A | * | 9/1988 | Ludwig | 312/221 |
| 4,993,784 | A | * | 2/1991 | Dana et al. | 312/221 |
| 5,074,627 | A | | 12/1991 | Broeders | |
| 5,176,436 | A | * | 1/1993 | Mitchell | 312/221 |
| 5,370,453 | A | * | 12/1994 | Wolff | 312/217 |
| 5,427,445 | A | * | 6/1995 | Mitchell | 312/221 |
| 5,599,078 | A | * | 2/1997 | Dechene et al. | 312/221 |
| 5,702,167 | A | * | 12/1997 | Muller | 312/221 |
| 5,782,545 | A | * | 7/1998 | Kahara et al. | 312/217 |
| 5,931,548 | A | * | 8/1999 | Bischoff | 312/221 |

(Continued)

FOREIGN PATENT DOCUMENTS

DE 9114787 A 2/1992

(Continued)

*Primary Examiner* — Darnell Jayne
*Assistant Examiner* — Hiwot Tefera
(74) *Attorney, Agent, or Firm* — Lucas & Mercanti, LLP

(57) ABSTRACT

Locking system for furniture drawers, including a rivet attached to the drawer which operates a locking device, all these locking devices are correlated through a base-plate fitted to the piece of furniture. The drawers have a height (H) such that this is a multiple of a predetermined dimension (d1). Each locking device includes a rocker, for actuation by the rivet, incorporated in a one-piece element bearing a surface cam for the rivet and a T-shaped back projection for sliding thereof in the base-plate. The height (m) of the one-piece element is such that the predetermined quantity (d1) is a multiple of said height (m); in such a way that the one-piece elements of the system interlock. The rivet is positioned at a distance (Z) from the side that is a multiple of the height (m) of the one-piece element.

1 Claim, 4 Drawing Sheets

U.S. PATENT DOCUMENTS

| | | | | |
|---|---|---|---|---|
| 5,997,114 | A * | 12/1999 | Bischoff | 312/215 |
| 6,109,708 | A * | 8/2000 | Walla et al. | 312/216 |
| 6,450,596 | B1 * | 9/2002 | Lee | 312/217 |
| 6,722,749 | B1 * | 4/2004 | Pagac | 312/221 |
| 6,966,619 | B2 * | 11/2005 | Muller | 312/221 |
| 7,144,092 | B1 * | 12/2006 | Chang | 312/217 |
| 7,293,845 | B2 * | 11/2007 | Hoffman | 312/219 |
| 7,637,576 | B2 * | 12/2009 | Sevillano Gil | 312/221 |
| 2003/0025425 | A1 * | 2/2003 | Cheng | 312/218 |
| 2003/0062810 | A1 * | 4/2003 | Westwinkel | 312/221 |
| 2005/0104485 | A1 * | 5/2005 | Chiu | 312/221 |
| 2005/0179346 | A1 * | 8/2005 | Ludwig et al. | 312/221 |
| 2008/0074017 | A1 * | 3/2008 | Ruan et al. | 312/221 |
| 2008/0106175 | A1 * | 5/2008 | Huang | 312/217 |

FOREIGN PATENT DOCUMENTS

| | | | |
|---|---|---|---|
| DE | 4342101 | A | 6/1994 |
| DE | 19527848 | A | 2/1997 |
| EP | 1059408 | A | 12/2000 |
| GB | 2220026 | A | 12/1989 |

* cited by examiner

LOCKING SYSTEM FOR FURNITURE DRAWERS

CROSS-REFERENCE TO RELATED APPLICATIONS

This application is a 371 of PCT/ES2007/000533 filed Sep. 20, 2007, which in turn claims the priority of ES P200700483 filed Feb. 23, 2007, the priority of both applications is hereby claimed and both applications are incorporated by reference herein.

BACKGROUND OF THE INVENTION

The object of the invention is a locking system for furniture drawers, of the type which consist of a bolt joined to the drawer which operates a locking device, all locking devices being intercorrelated by a flat-base mounted on the furniture unit; said locking devices can move in two directions on the flat base.

In the current state of the art, various locking systems are already known for furniture drawers, such as those which, on opening to any one of them, cause the self-locking closure of the remaining drawers, thus preventing the furniture unit from turning over: Specifically, Patent EP1059408, from the same applicant, describes a locking system of the type which consist of a bolt joined to the drawer which operates a corresponding locking device, all locking devices being intercorrelated by a flat-base mounted on the furniture unit and on which:

a) the flat-base mounts a group of support modules with means to move longitudinally on it in two directions and each support module mounts a fixed locking device, with means for its mutual interlocking/unlocking applying linear stress in angled direction with respect to the direction of the movement of the drawer;

b) the direction of the application of linear stress is orthogonal to the direction of the movement of the drawer.

The locking system, in accordance with the invention, eliminates the need to include said support modules, as the locking device itself incorporates the means to move longitudinally on the flat-base.

BRIEF SUMMARY OF THE INVENTION

In the locking system, according to the invention:

a) the furniture unit which incorporates the locking devices has drawers of a height (H) which is a multiple of a minimum predetermined dimension (d1).

b) each locking device consists of $b_1$) a rocker, to be operated by the bolt of the drawer, built into $b_2$) a monobloc element with a surface cam for the bolt and a "T"-shaped rear salient for its sliding on the flat-base;

c) each monobloc element of each locking device has a height (m) so that said dimension ($d_1$) is a multiple of said height ($d_1$);

d) the corresponding bolt is placed, joined to the corresponding drawer at a distance (Z) from the edge which is a multiple of the height (m) of the monobloc element of each locking device;

e) all of said monobloc elements are placed to stop against each other.

To better understand the object of this invention, a preferred method of practical realization is shown on the diagrams, subject to additional changes which do not alter its basis.

DETAILED DESCRIPTION OF THE INVENTION

The following is an example of practical, non-limiting realization of this invention.

The locking system for furniture drawers, according to the invention, used basically in office furniture and similar, mounts in correlation with all the drawers (C) of a furniture unit (M), a flat-base (1), or equivalent guide means, mounted on the furniture unit (M) with known means.

In said flat-base (1) a group of locking devices (D) can move linearly in two directions.

The drawers (C) of the furniture unit (M) each have a bolt (B) joined to the corresponding drawer (C).

The system according to the invention is completed, for example, placing means above which tend to maintain the locking devices (D) self-positioned between each other and means of locking the unit in its closed position. These means are not the object of the invention.

Figure 1:
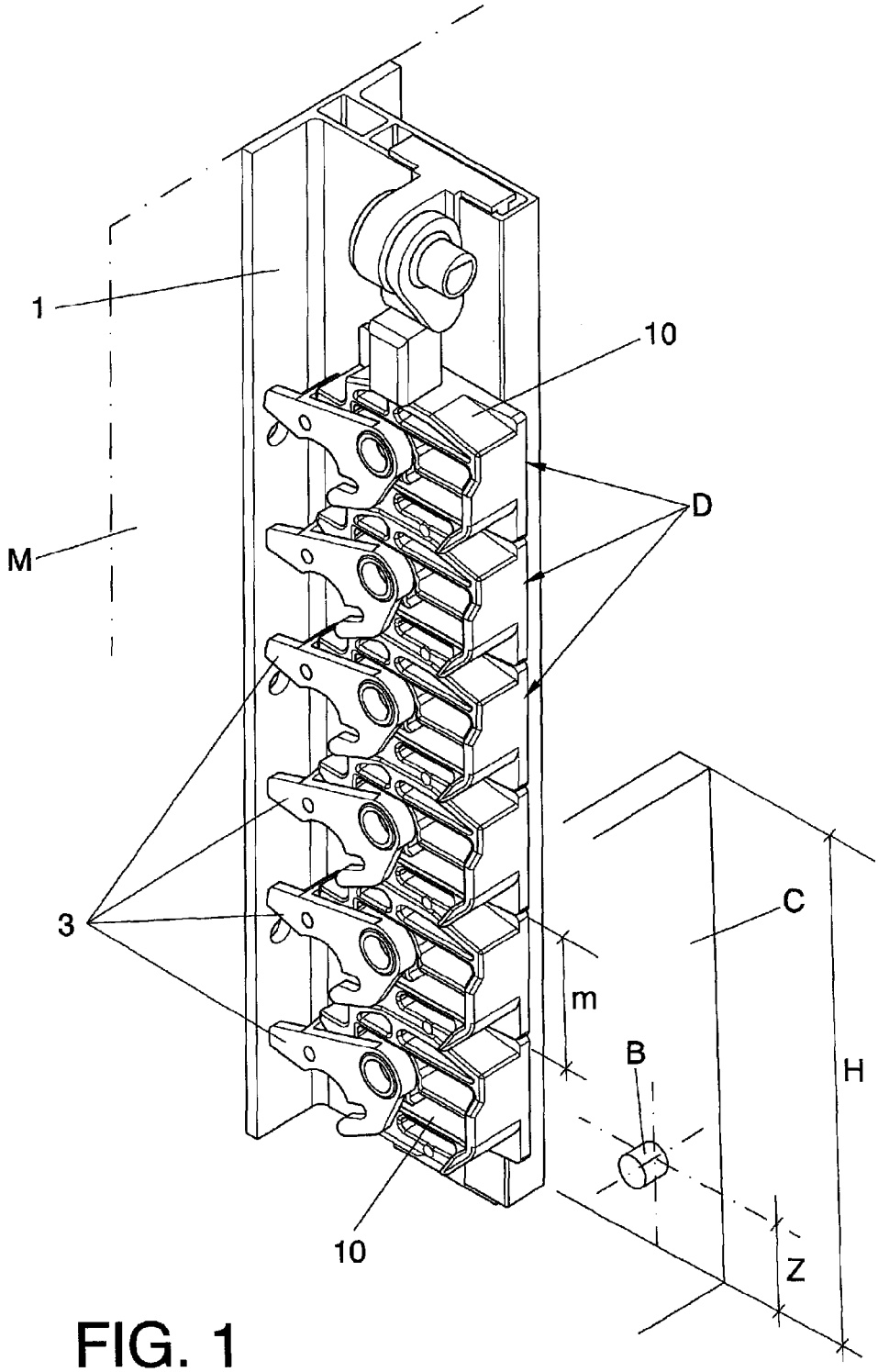
FIG. 1 is a perspective view and represents, in diagram form, the locking system for furniture drawers which is the object of the invention with its basic components.
Figure 2:
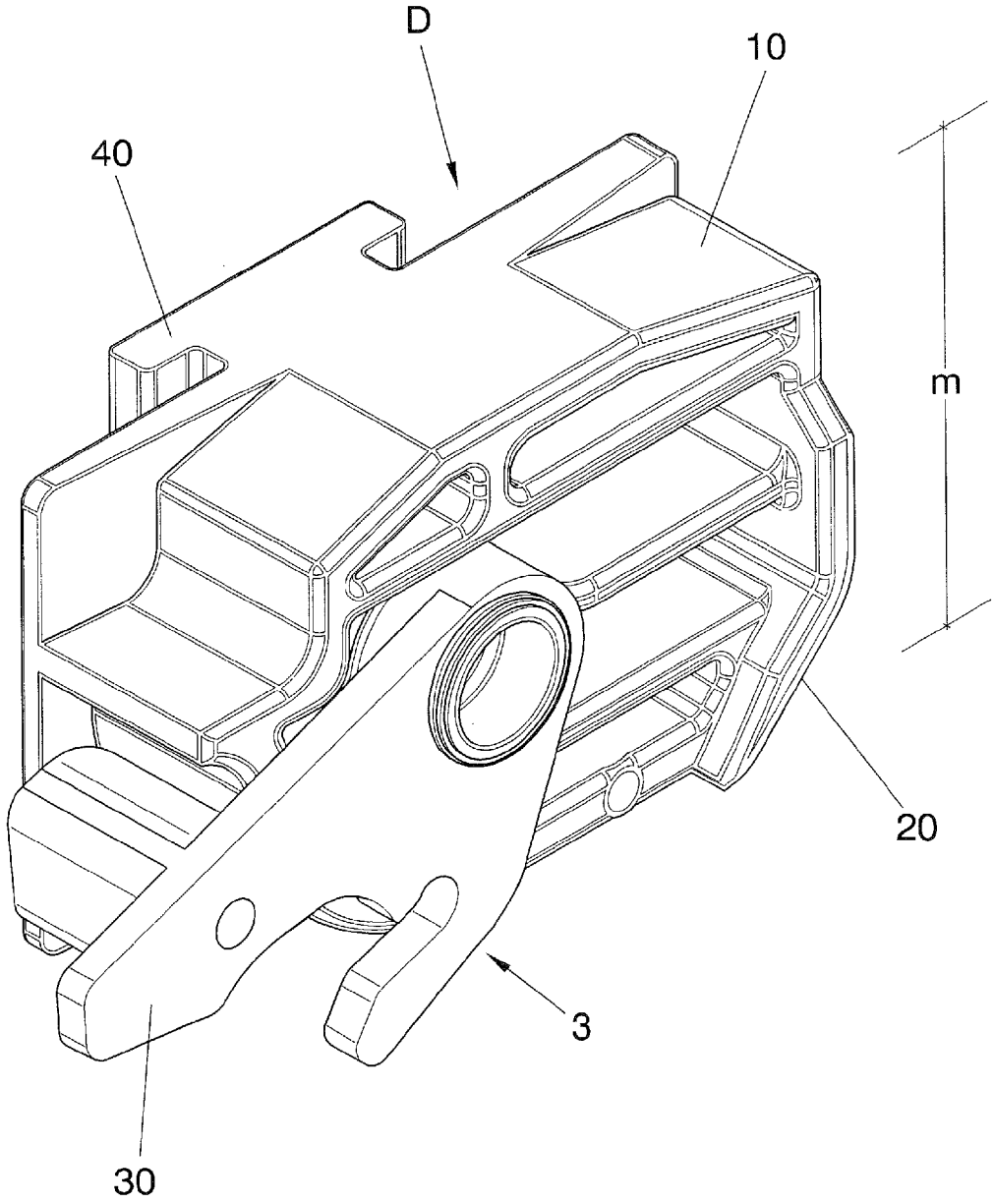
FIG. 2 is a perspective detail view of a locking device (D) with its components and special characteristics for a non-limiting example of practical realization.
Figure 3:
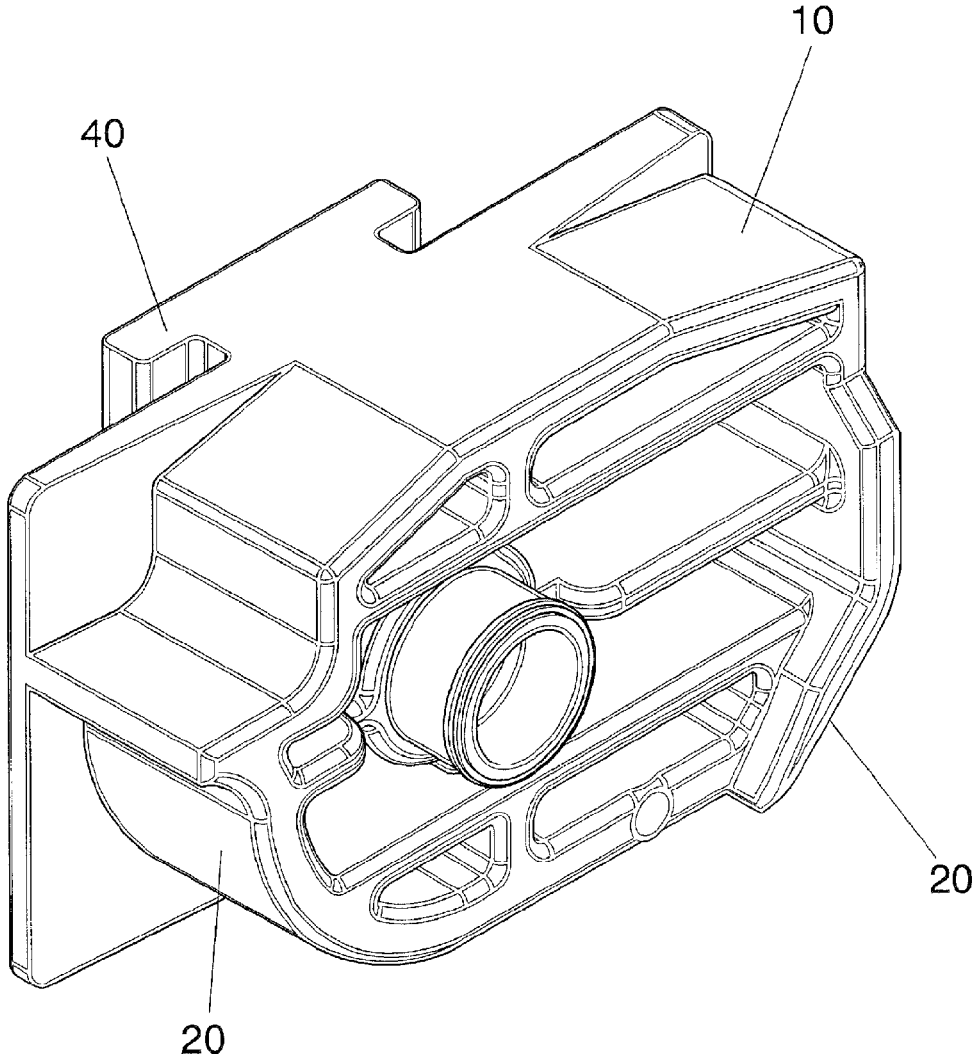
FIG. 3 is a perspective view which represents the monobloc element (10); that is, the locking device (D) of FIG. 2 without the rocker (3).
Figure 4:
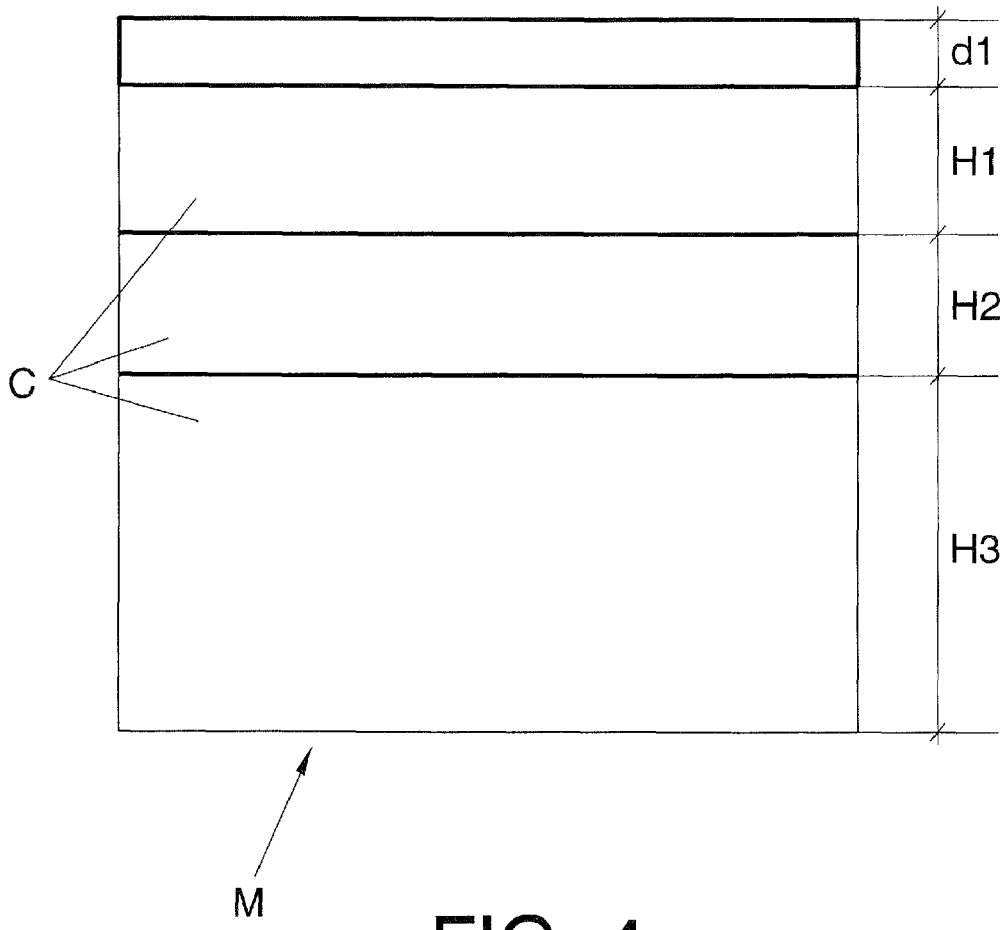
FIG. 4 represents a front diagram view of a furniture unit (M) with drawers (C); indicating in it the different dimensions (H) and the predetermined dimension (d1).

In accordance with the invention, the height (H) of the furniture unit (M) drawers (C) is such that it is always a multiple of a predetermined dimension ($d_1$); that is, the predetermined dimension ($d_1$) repeats an entire number of times for each height (H) of each drawer (C) and this always occurs, with all drawers, (C) regardless of the height of each drawer (C)—which may be the same (H) for all the drawers (C) or different—($H_1$), ($H_2$), ($H_3$) in FIG. 4—for one or several of them.

Each locking device (D) consists of a rocker (3), to be operated by the bolt (B) of the corresponding drawer (C), and a monobloc element (10) which defines a surface-cam (20) for said bolt (B) and a "T"-shaped rear salient (40) consisting of a guide for it to slide on the flat-base (1).

The predetermined dimension ($d_1$) is, in turn, a multiple of the height (m) of each monobloc element (10).

In each drawer (C), the bolt (B) is placed at a certain distance (Z) from the edge. Said distance (Z) is, in turn, a multiple of the height (m) of each monobloc element (10).

With this structuring and special characteristics, the monobloc elements (10) of the system stop against each other. On operating a drawer (C) its corresponding bolt (B) always operates a rocker (3) of one of the locking devices (D).

The invention claimed is:

1. A locking system for furniture drawers comprising a bolt joined to a drawer, a plurality of locking devices intercorrelated by a flat-base mounted on a furniture unit; said plurality of locking devices being stacked on top of each other and being movable linearly in two directions on the flat-base wherein:

a) the furniture unit which incorporates the plurality of locking devices has drawers of a height which is a multiple of a predetermined dimension;

b) each locking device of the plurality of locking devices comprises:

a rocker operated by the bolt built into a monobloc element carrying a surface cam for the bolt and a "T"-shaped rear salient slidable on the flat-base, the height of the monobloc element being an amount such that the predetermined dimension is a multiple of said height; so that the monobloc element from each locking device of the plurality of locking devices stops against each other;

the rocker having an axis on which the rocker rocks, the axis being transverse and bisect to the "T"-shaped rear salient of the monobloc element;

c) the bolt placed at a distance from the edge of the drawer is a multiple of the height of the monobloc element, and d) each monobloc element stops against each other;

the predetermined dimension repeats an entire number of times for each height of each drawer, each drawer selected from a plurality of sizes, so that on operating the drawer, its corresponding bolt always operates the rocker of one of the locking devices.

* * * * *